United States Patent [19]

Shapiro et al.

[11] Patent Number: 4,901,392

[45] Date of Patent: Feb. 20, 1990

[54] CONNECTOR BETWEEN BRUSH AND HANDLE

[76] Inventors: David Shapiro, 58-23 251 St., Little Neck, N.Y. 11362; George Spector, 233 Broadway Rm 3815, New York, N.Y. 10007

[21] Appl. No.: 207,530

[22] Filed: Jun. 16, 1988

[51] Int. Cl.[4] ..... A46B 15/00

[52] U.S. Cl. ..... 15/172

[58] Field of Search ..... 15/143 R, 143 A, 143 B, 15/144 R, 144 A, 144 B, 145, 146, 159 R, 172, 229.6, 229.7, 229.8, 229.9, 244.2, 176.1, 176.2, 176.3, 176.4, 176.5, 176.6, 171, 147 R, 147 A, 147 B, 147 C, 147 D, 178, 177, 160, 173, 174, 175, 148, 149, 150, 151, 152, 153, 154, 201; D4/121, 130, 131, 132, 133, 134; D32/50, 51, 52; 16/110 R, 114 R; 403/161, 162, 163, 165, 362

[56] References Cited

U.S. PATENT DOCUMENTS

| | | | |
|---|---|---|---|
| 555,854 | 3/1896 | Davenport | 15/145 X |
| 1,885,540 | 11/1932 | Oberti | 15/143 R |
| 2,496,010 | 1/1950 | Lotters | 15/172 X |
| 2,799,037 | 7/1957 | Grogan | 15/176.3 X |
| 2,966,689 | 1/1961 | Antonucci, Jr. | 15/244.2 X |
| 3,090,066 | 5/1963 | Ferrell Jr. et al. | 15/144 R X |
| 3,506,996 | 4/1970 | Brennan | 15/144 R |

FOREIGN PATENT DOCUMENTS

| | | | |
|---|---|---|---|
| 68712 | 5/1944 | Denmark | 15/172 |
| 2523825 | 9/1983 | France | 15/172 |
| 322198 | 6/1957 | Switzerland | 15/172 |

*Primary Examiner*—Harvey C. Hornsby
*Assistant Examiner*—Scott J. Haugland

[57] ABSTRACT

A brush to handle connector for a push broom is provided for adjustably attaching the handle to the brush head in such a manner as to allow user of the push broom to twist the brush head in various directions and retain it thereby allowing the user to fit the brush head into narrow spaces by changing the angle between the brush head and the handle.

6 Claims, 1 Drawing Sheet

CONNECTOR BETWEEN BRUSH AND HANDLE

BACKGROUND OF THE INVENTION

The instant invention relates generally to handle attaching structures for brooms and the like and more specifically it relates to a brush to handle connector for a push broom permitting the brush to pivot to an adjusted position when engaging a fixed object so as to fit into normally inaccessable spaces.

Numerous handle attaching structures for brooms and the like have been provided in prior art that are adapted to adjustably connect handles to the brooms and the like by fasteners. For example, U.S. Pat. Nos. 2,764,774; 4,293,972 and 4,399,581 all are illustrative of such prior art. While these units may be suitable for the particular purpose to which they address, they would not be as suitable for the purposes of the present invention as heretofore described.

SUMMARY OF THE INVENTION

A primary object of the present invention is to provide a brush to handle connector for a push broom that will overcome the shortcomings of the prior art devices.

Another object is to provide a brush to handle connector for a push broom that makes a dependable and secure attachment between the handle and the brush head and at the same time providing adjustability of the angle of the brush head with respect to the handle, responsive to engagement with a fixed object whereby the brush head moves to a tilted inclination permitting access to otherwise obstructed areas and preventing damage to the connection if it were fixed.

An additional object is to provide a brush to handle connector for a push broom in which gearing is employed to turn the brush head so as to change the angle of the brush head with respect to the handle although the head will turn when pushed hard enough against a fixed object.

A further object is to provide a brush to handle connector for a push broom that is simple and easy to use.

A still further object is to provide a bursh to handle connector for a push broom that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
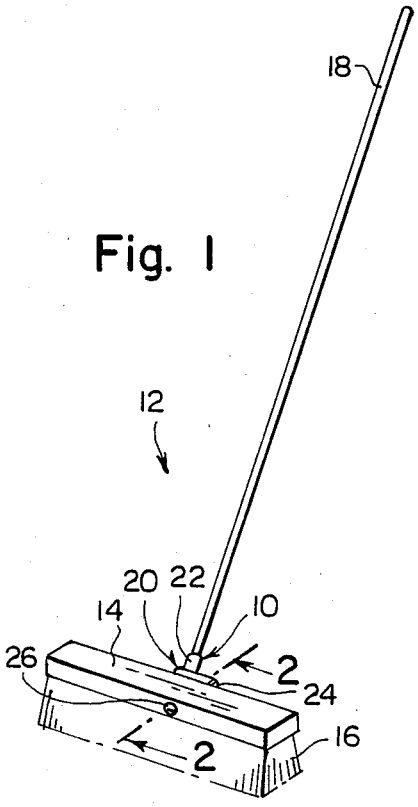
FIG. 1 is a perspective view of the invention installed into a push broom.
Figure 2:
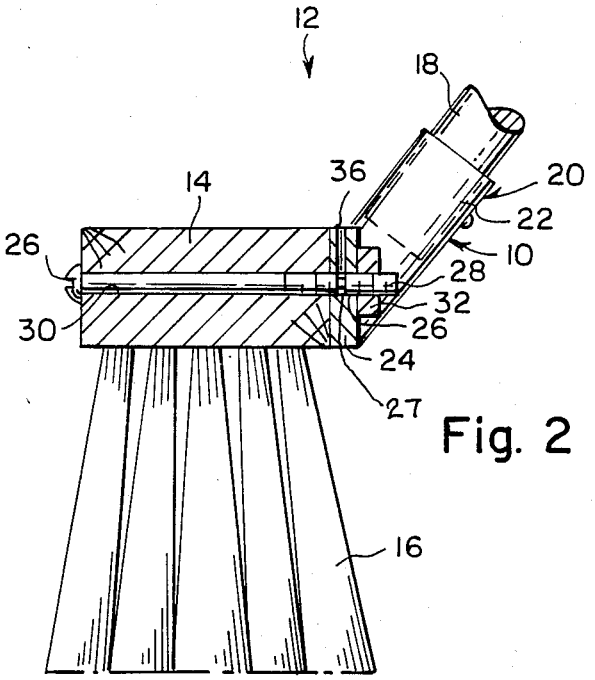
FIG. 2 is a cross sectional view taken along line 2—2 in FIG. 1 showing one type of retainer.

Turning now descriptively to the drawings, in which similar reference characters denote similar elements throughout the several views, FIGS. 1 and 2 illustrate a brush to handle connector 10 for a push broom 12 that has a brush head 14 with extending bristles 16 and an elongated handle 18. The connector 10 consists of a structure 20 for adjustably attaching the handle 18 to the brush head 14 in such a manner as to allow user of the push broom 12 to twist the brush head 14 in various directions, thereby allowing the user to fit the brush head 14 into narrow spaces and by changing the angle between the brush head 14 and the handle 18 to use the push broom 12 more easily and more efficiently than with the usual rigid connection. A fastener is provided for retaining the brush head 14 to the structure 20 so that no matter how hard the push broom 12 is pushed, the handle 18 will not break because the structure 20 will force the handle 18 to twist in hands of the user before the handle 18 will break.

Figure 2A:
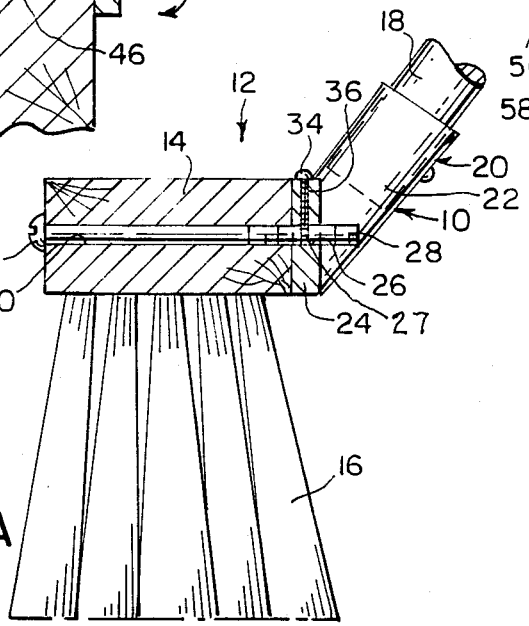
FIG. 2A is a cross sectional view similar to FIG. 2 showing another type of retainer.

The structure 20 includes a sleeve 22 secured to lower end of the handle 18 while a lug 24 having a threaded aperture is affixed to lower end of the sleeve 22 in such a manner that the sleeve extends angularly therefrom. A bolt 26 having an annular groove 27 in a threaded shaft 28 which extends transversely through an aperture 30 in the brush head 14 and through the threaded aperture in the lug 24. The fastener 19 is a nut 32 which when threaded onto distal end of the threaded shaft 28 of the bolt 26 and is tightened against the brush head 14, will hold the brush head thereto and still allow it to twist. Instead of the nut 32, a set screw 34, shown in FIG. 2A can be used which when threadably inserted into threaded aperture 36 in the lug 24 at right angles to and intersecting the annular groove 27 in the threaded shaft 28 of the bolt 26 will hold the brush head 14 thereto and still allow it to twist.

Figure 3:
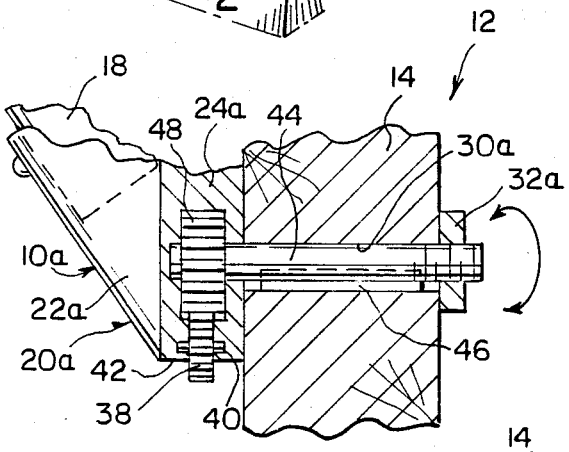
FIG. 3 is a cross sectional view of a first modification in which gearing is employed within the lug to turn the brush head.

A first modified connector **10*a* is shown in FIG. 3 in which structure 20*a* includes a sleeve 22*a* secured to lower end of the handle 18 while a lug 24*a* is transversely affixed to lower end of the sleeve 22*a* in such a manner that the sleeve 22*a* extends angularly therefrom. A thumb wheel gear 38 is rotatably mounted on axle 40 within the lug 24*a* in such a manner that the thumb wheel gear 38 extends from edge 42 of the lug 24*a*. A shaft 44 extends transversely through an aperture 30*a* in the brush head 14 and into the lug 24*a* while a key 46 is provided for securing a portion of the shaft 44 within the aperture 30*a* in the bursh head 14 to the brush head. A shaft gear 48 is affixed to a portion of the shaft 44 within the lug 24*a*. The shaft gear 48 is engageable with the thumb wheel gear 38 so that when the user of the push broom 12 rotates the thumb wheel gear 38 the brush head 14 will twist. A nut 32*a* similar to nut 32 is threaded onto distal end of the shaft 46 and tightened against the brush head 14** which will hold the brush head thereto and still allow it to twist.

Figure 4:
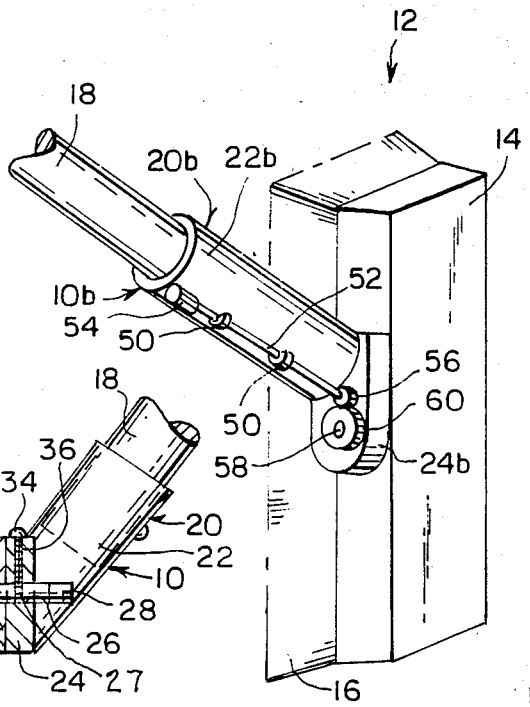
FIG. 4 is a perspective view of a second modification in which gearing is employed along side of sleeve and on the lug to turn the brush head.

A second modified connector **10*b* is shown in FIG. 4 in which structure 20*b* includes a sleeve 22*b* secured to lower end of the handle 18 while a lug 24*b* is transversely affixed to lower end of the sleeve 22*b* in such a manner that the sleeve 22*b* extends angularly therefrom. A pair of collars 50 are spaced apart and formed onto outer surface of the sleeve 22b in an alignment. An elongated rod 52 extends through the collars 50 so as to be parallel with the sleeve 22b. The rod 52 has a knob 54 at upper end thereof and a small gear 56 at lower end thereof at the lug 24b. A shaft 58 extends through the lug 24b and is affixed transversely within the brush head 14. A large gear 60 is affixed onto distal end of the shaft 58 and is engageable with the small gear 56 so that when user of the push broom 12 rotates the knob 54 the brush head 14** will twist.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A brush to handle connector for a push broom having a brush head with extending bristles and an elongated handle, said connector comprising:

(a) means for adjustably attaching the handle to the brush head in such a manner as to allow user of the push broom to twist the brush head in various directions, thereby allowing the user to fit the brush head into narrow spaces and by changing the angle between the brush head and the handle to use the push broom more easily and more efficiently than with the usual rigid connection; and (b) means for retaining the brush head to said adjustably attaching means for angular adjustment, wherein said adjustably attaching means includes:

(c) a sleeve secured to lower end of the handle;

(d) a lug having a threaded aperture, said lug transversly affixed to lower end of said sleeve in such a manner that said sleeve extends angularly therefrom; and (e) a bolt having an annular groove in a threaded shaft which extends transversely through the brush head and through the threaded aperture in said lug.

2. A brush handle connector for a push broom as recited in claim 1, wherein said retaining means is a nut which when threaded onto the distal end of the threaded shaft of said bolt and tightened against the brush head will hold the brush on the handle and still allow it to twist.

3. A brush handle connector for a push broom as recited in claim 1, wherein said retaining means is a set screw which when threadably inserted into said lug at right angles to and intersecting the annular groove in the threaded shaft of said bolt will hold said brush head on the handle and still allow it to twist.

4. A brush to handle connector for a push broom comprising:

(a) means for adjustably attaching the handle to the brush head in such a manner as to allow user of the push broom to twist the brush head in various directions, thereby allowing the user to fit the brush head into narrow spaces and by changing the angle between the brush head and the handle to use the push broom more easily and more efficiently than with the usual rigid connection; and (b) means for retaining the brush head to said adjustably attaching means for angular adjustment, wherein said adjustably attaching means includes:

(c) a sleeve secured to lower end of the handle;

(d) a lug transversely affixed to lower end of said sleeve in such a manner that said sleeve extends angularly therefrom;

(e) a thumb wheel gear rotatably mounted within said lug in such a manner that said thumb wheel gear extends from edge of said lug;

(f) a shaft extending transversely through the brush head and into the lug;

(g) means for securing a portion of said shaft within said brush head to said brush head; and (h) a shaft gear affixed to a portion of said shaft within said lug, said shaft gear being engageable with said thumb wheel gear so that when the user of said push broom rotates said thumb wheel gear the brush head will twist.

5. A brush to handle connector for a push broom as recited in claim 4, wherein said retaining means is a nut which when threaded onto distal end of said shaft and tightened against the brush head will hold the brush head thereto and still allow it to twist.

6. A brush to handle connector for a push broom comprising:

(a) means for adjustably attaching the handle to the brush head in such a manner as to allow user of the push broom to twist the brush head in various directions, thereby allowing the user to fit the brush head into narrow spaces and by changing the angle between the brush head and the handle to use the push broom more easily and more efficiently than with the usual rigid connection; and (b) means for retaining the brush head to said adjustably attaching means for angular adjustment, wherein said adjustably attaching means includes:

(c) a sleeve secured to lower end of the handle;

(d) a lug transversely affixed to lower end of said sleeve in such manner that said sleeve extends angularly therefrom;

(e) a pair of collars spaced apart and formed onto outer surface of said sleeve in an alignment;

(f) an elongated rod extending through said collars so as to be parallel with said sleeve, said rod having a knob at upper end thereof and a small gear at lower end thereof at said lug;

(g) a shaft extending through said lug and affixed transversely within said brush head; and (h) a large gear affixed onto distal end of said shaft and engageable with said small gear so that when user of said push broom rotates said knob the brush head will twist.

* * * * *